US010291988B2

(12) United States Patent
Gu et al.

(10) Patent No.: US 10,291,988 B2
(45) Date of Patent: May 14, 2019

(54) VIBRATION DIAPHRAGM

(71) Applicant: AAC Technologies Pte. Ltd., Singapore (SG)

(72) Inventors: Xiaojiang Gu, Shenzhen (CN); Meiwei Wu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/831,793

(22) Filed: Dec. 5, 2017

(65) Prior Publication Data

US 2018/0367909 A1 Dec. 20, 2018

(30) Foreign Application Priority Data

Jun. 20, 2017 (CN) ..... 2017 2 0723555 U

(51) Int. Cl.

| | |
|---|---|
| ***H04R 11/02*** | (2006.01) |
| ***H04R 7/12*** | (2006.01) |
| ***H04R 9/06*** | (2006.01) |
| ***H04R 7/06*** | (2006.01) |
| *H04R 7/18* | (2006.01) |
| *H04R 31/00* | (2006.01) |

(52) U.S. Cl.

CPC ..... *H04R 7/127* (2013.01); *H04R 7/06* (2013.01); *H04R 9/06* (2013.01); *H04R 7/18* (2013.01); *H04R 31/003* (2013.01)

(58) Field of Classification Search

CPC ... H04R 9/06; H04R 7/16; H04R 7/18; H04R 9/043; H04R 9/027; H04R 7/20; H04R 7/04

See application file for complete search history.

(56) References Cited

U.S. PATENT DOCUMENTS

| | | | | |
|---|---|---|---|---|
| 8,397,861 | B1 * | 3/2013 | Xu | H04R 7/18 181/171 |
| 9,961,448 | B2 * | 5/2018 | Huang | H04R 7/16 |

* cited by examiner

*Primary Examiner* — Amir H Etesam
(74) *Attorney, Agent, or Firm* — Na Xu; IPro, PLLC

(57) ABSTRACT

The present disclosure provides a vibration diaphragm. The vibration diaphragm includes a vibration part; a suspension extending from and surrounding the vibration part; and a pattern module part formed on the vibration part. The pattern module part includes a ring-shaped first protrusion, and at least two second protrusions bounded by the ring-shaped first protrusion. The second protrusions each has two ends connected to the ring-shaped first protrusion. By virtue of the configuration of the pattern module part, the solution described by the present embodiment increases the surface area of the vibration part, and widens the bandwidth of the vibration diaphragm, and further improves the acoustic performance of the diaphragm.

5 Claims, 2 Drawing Sheets

VIBRATION DIAPHRAGM

FIELD OF THE PRESENT DISCLOSURE

The present disclosure relates to electro-acoustic transducers, more particularly to a vibration diaphragm for radiating audible sounds.

DESCRIPTION OF RELATED ART

With the rapid development of portable devices like mobile phone etc, people's requirement to the performance of the product is becoming stronger and stronger, and there is a vibration mode of music belt for the music appreciation of the mobile phone, in order to strengthen the entertaining effect, thus, the development of the sounding instrument is accelerating accordingly.

The sounding instrument with relevant technology comprises a frame, a vibration diaphragm supported on the frame and a voice coil driving the vibration of the vibration diaphragm. The vibration diaphragm comprises a dome and a suspension extending along the dome, and the voice coil is fixed on the suspension.

However, in the vibration diaphragm with relevant technologies, the dome is a simple plane structure, and this structure makes the acoustic performance of the vibration diaphragm not improved further, and affects badly the acoustic performance of the vibration diaphragm.

Therefore it is necessary to provide an improved vibration diaphragm for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
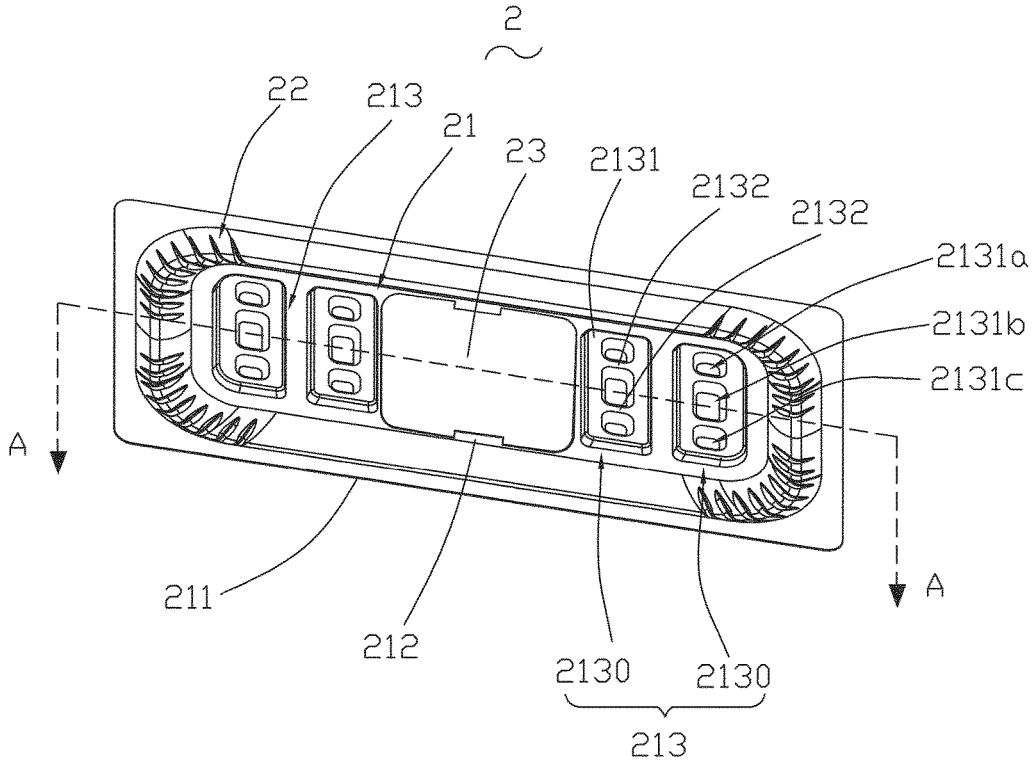
FIG. 1 is an illustrative isometric view of a vibration diaphragm in accordance with an exemplary embodiment of the present disclosure.
Figure 2:
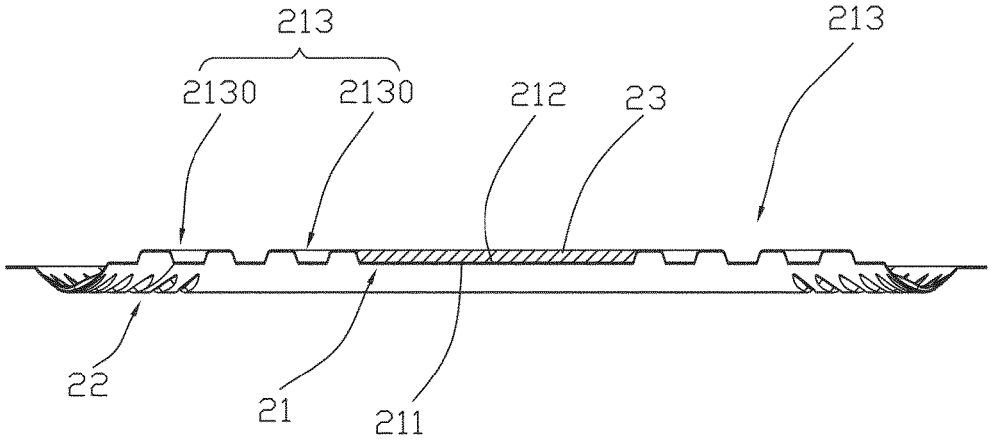
FIG. 2 is a cross-sectional view of the vibration diaphragm in FIG. 1, taken along line A-A.

Referring to FIGS. 1-2, a vibration diaphragm 2 in accordance with an exemplary embodiment of the present disclosure is disclosed. The vibration diaphragm 2 includes a vibration part 21, a suspension 22 extending from and surrounding the vibration part 21, and a dome 23 attached to the vibration part 21.

The vibration art 21 includes a bottom surface 211, a top surface 212 opposed to the bottom surface 21, and a pattern module part 213.

The pattern module part 213 is formed on the bottom surface 211 and/or the top surface 212. Further, the pattern module part 213 is formed by being concave or convex from the top surface 212 or the bottom surface 211.

In this embodiment, the pattern module part 213 includes a pair of pattern units 2130. Each of the pattern units includes a ring-shaped first protrusion 2131, and at least two second protrusions 2132 bounded by the ring-shaped first protrusion 2131. The first protrusion 2131 surrounds the second protrusions 2132, and each of the second protrusions 2132 has two ends connected to the ring-shaped first protrusions 2131. In other words, the second protrusions 2132 locate in an area bounded by the ring-shaped first protrusion 2131 and connect to the ring-shaped first protrusion 2131. In the embodiment, the first protrusion 2131 is convex along a direction from the bottom surface 211 toward the top surface 212. The second protrusion 2132 is convex along the same direction. According to FIGS. 1-2, the ring-shaped first protrusion 2131 is substantially a rectangular having a long side parallel to a short axis of the vibration diaphragm 2 and a short side parallel to a long axis of the vibration diaphragm 2. The second protrusion 2132 is parallel to the long side of the ring-shaped first protrusion 2131.

In this embodiment, the second protrusion 2132 divides the ring-shaped first protrusion 2131 into three parts—a first part 2131*a*, a second part 2131*b*, and a third part 2131*c*. A length of the first part is substantially same to a length of the third part 2131*c*, and the length of the first part 2131*a* is smaller than a length of the second part 2131*b*. In this embodiment, the second part 2131*b* is locates between the first and third parts 2131*a*, 2131*c*. Here, the length is defined along the short axis of the vibration diaphragm 2.

Optionally, the vibration diaphragm 2 includes two pattern module parts 213 symmetrical about the short axis the vibration diaphragm 2 for ensuring the balance of the vibration of the diaphragm.

The pattern module part 213 increases the surface area of the vibration part 21, and widens the bandwidth of the vibration diaphragm 2, and further improves the acoustic performance of the diaphragm. In this embodiment, the suspension is a concave form toward the bottom surface 211.

The dome 23 is fixed to the top surface 212 of the vibration part 21, and locates between the two pattern module parts 213.

Figure 3:
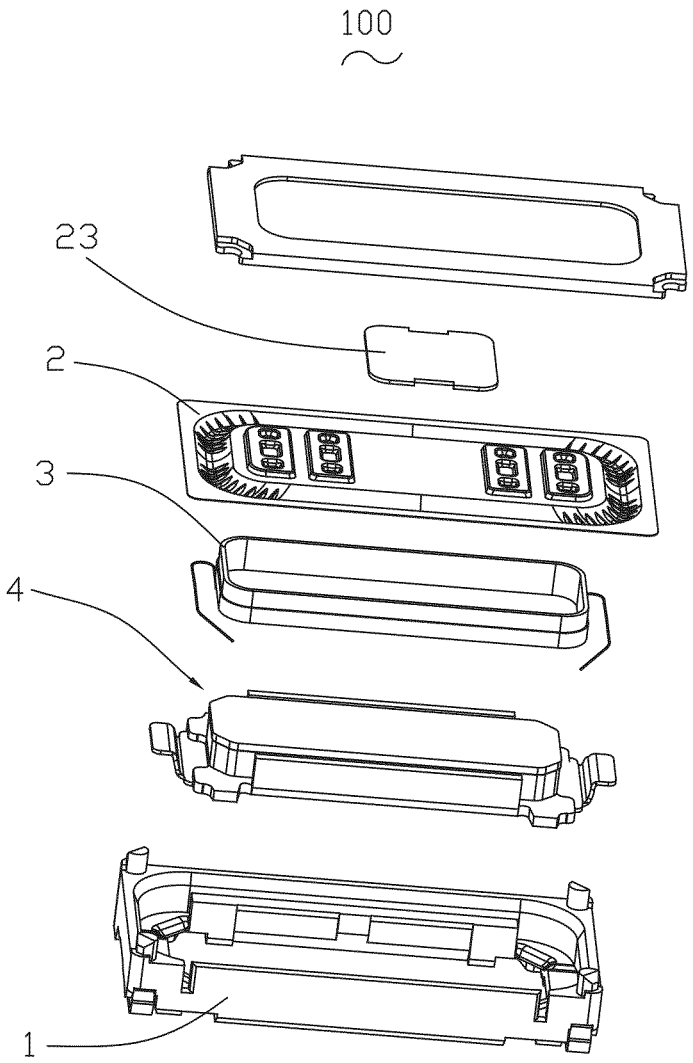
FIG. 3 is an exploded view of a sound generator using the vibration diaphragm in FIG. 1.

Referring to FIG. 3, the present disclosure further discloses a sound generator 100 including a frame 1, a vibration diaphragm 2 supported by the frame 1, a voice coil 3 for driving the vibration diaphragm 2, and a magnetic circuit system 4 positioned by the frame 1. The voice coil 3 is fixed by the vibration part 21 of the vibration diaphragm 2.

By virtue of the configuration of the pattern module part, the solution described by the present embodiment increases the surface area of the vibration part, and widens the bandwidth of the vibration diaphragm, and further improves the acoustic performance of the diaphragm.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A vibration diaphragm comprising:

a vibration part;

a suspension extending from and surrounding the vibration part;

a pattern module part formed on the vibration part; wherein the pattern module part includes a ring-shaped first protrusion, and at least two second protrusions bounded by the ring-shaped first protrusion, and wherein the second protrusions each has two ends connected to the ring-shaped first protrusion, the ring-shaped first protrusion includes a long side parallel to a short axis of the vibration diaphragm and a short side parallel to a long axis of the vibration diaphragm, the two ends of the second protrusion are parallel to the long axis of the vibration diaphragm and connected to the long sides of the ring-shaped first protrusion, the second protrusions divide the ring-shaped first protrusion into a first part, a second part and a third part, a length of the first part along the short axis is same to a length of the third part, and the length of the first part is smaller than a length of the second part.

2. The vibration diaphragm as described in claim 1, wherein the pattern module part includes two pattern units each having one ring-shaped first protrusion and two second protrusions.

3. The vibration diaphragm as described in claim 2 including two pattern module parts symmetric about the short axis of the vibration diaphragm.

4. The vibration diaphragm as described in claim 2 further including a dome attached to the vibration diaphragm and located between the two pattern module parts.

5. A sound generator, including:

a frame;

a vibration diaphragm as described in claim 1 supported by the frame; and a voice coil for driving the vibration diaphragm.

* * * * *